US011402785B2

(12) United States Patent
Tsutsumi

(10) Patent No.: US 11,402,785 B2
(45) Date of Patent: Aug. 2, 2022

(54) IMAGE FORMING APPARATUS

(71) Applicant: KYOCERA Document Solutions Inc., Osaka (JP)

(72) Inventor: Yoshiaki Tsutsumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 41 days.

(21) Appl. No.: 16/925,201

(22) Filed: Jul. 9, 2020

(65) Prior Publication Data

US 2021/0018870 A1 Jan. 21, 2021

(30) Foreign Application Priority Data

Jul. 19, 2019 (JP) ..... JP2019-133664

(51) Int. Cl.
*G03G 15/00* (2006.01)
*G03G 21/18* (2006.01)

(52) U.S. Cl.
CPC ..... *G03G 15/6558* (2013.01); *G03G 15/607* (2013.01); *G03G 21/1821* (2013.01)

(58) Field of Classification Search
CPC ..... B65H 2220/02; B65H 2220/01; G03G 15/5062; G03G 15/234; G03G 15/5016
See application file for complete search history.

(56) References Cited

U.S. PATENT DOCUMENTS

2016/0378034 A1* 12/2016 Taniguchi ..... G03G 15/553 399/81
2017/0149992 A1* 5/2017 Tanaka ..... G03G 15/20
2017/0149996 A1* 5/2017 Sei ..... H04N 1/3263
2018/0039213 A1* 2/2018 Endoh ..... G03G 15/553
2018/0089545 A1* 3/2018 Ikeda ..... G03G 15/161
2018/0257418 A1* 9/2018 Shimada ..... G03G 21/00

FOREIGN PATENT DOCUMENTS

JP 2004-117428 A 4/2004

* cited by examiner

*Primary Examiner* — Jessica L Eley
(74) *Attorney, Agent, or Firm* — Studebaker & Brackett PC

(57) ABSTRACT

An image forming apparatus includes an image forming section, a detector, and a display section. The image forming section forms an image on a first side of a sheet. The sheet has the first side and a second side. The detector is positioned upstream of the image forming section in a sheet conveyance direction. The detector detects whether or not an image has been formed on the first side of the sheet. The display section displays information indicating that an image has been formed on the first side of the sheet when the detector detects that an image has been formed on the first side of the sheet.

7 Claims, 8 Drawing Sheets

Tb

| C1 User name | C2 User ID | C3 Threshold | C4 Detection count |
|---|---|---|---|
| User 1 | NN1 | 5 | 0 |
| User 2 | NN2 | 10 | 1 |
| ⋮ | ⋮ | ⋮ | ⋮ |

FIG. 6

IMAGE FORMING APPARATUS

INCORPORATION BY REFERENCE

The present application claims priority under 35 U.S.C. § 119 to Japanese Patent Application No. 2019-133664, filed on Jul. 19, 2019. The contents of this application are incorporated herein by reference in their entirety.

BACKGROUND

The present disclosure relates to an image forming apparatus.

With consideration to responses to environmental problems and the reuse of resources, a used sheet on only one side of which an image has been formed (may be referred to in the following as a "reused sheet") is reused so that another image is formed on the other side of the sheet in an image forming apparatus such as a printer or copier. The image forming apparatus includes a paper information setting member which sets the reused sheet to be housed in a paper feed cassette.

SUMMARY

An image forming apparatus according to an aspect of the present disclosure includes an image forming section, a detector, and a reporting section. The image forming section forms an image on a first side of a sheet. The sheet has the first side and a second side. The detector is positioned upstream of the image forming section in a sheet conveyance direction. The detector detects whether or not an image has been formed on the first side of the sheet. The reporting section reports information indicating that an image has been formed on the first side of the sheet when the detector detects that an image has been formed on the first side of the sheet.

BRIEF DESCRIPTION OF THE DRAWINGS

FIG. 6 is a diagram illustrating a threshold table in the second embodiment of the present disclosure.

DETAILED DESCRIPTION

Figure 1:
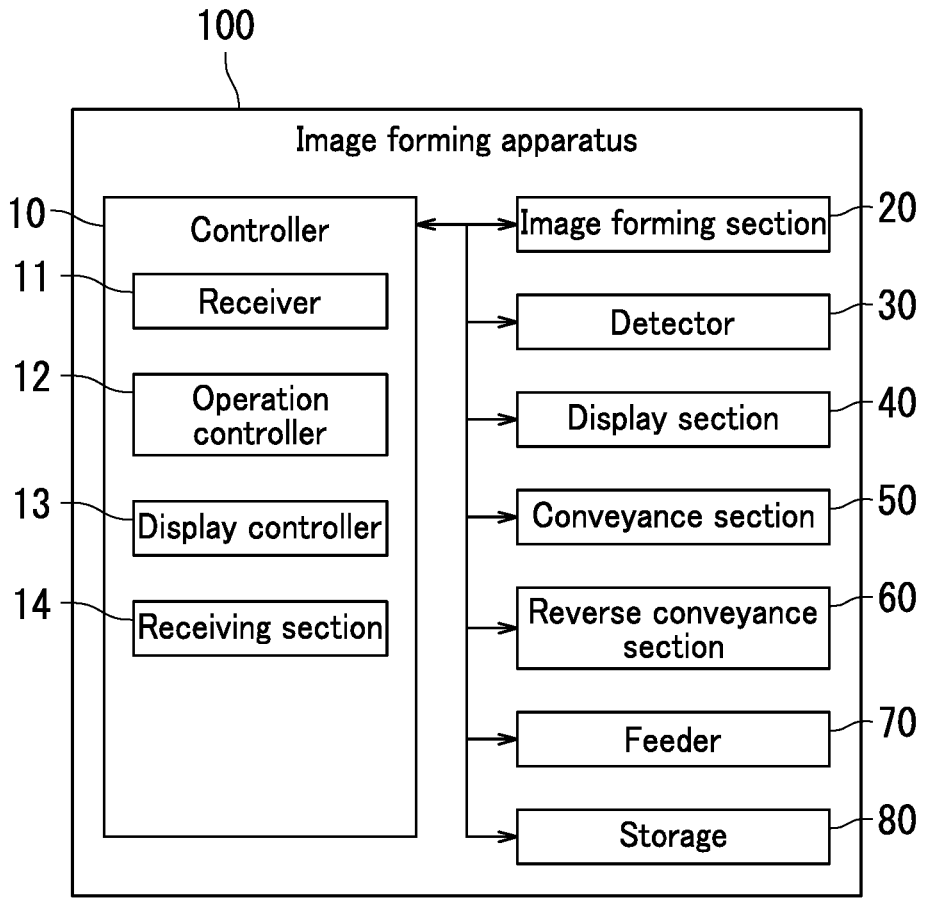
FIG. 1 is a diagram illustrating the image forming apparatus according to a first embodiment of the present disclosure.

The following describes embodiments of the present disclosure with reference to the accompanying drawings.

Elements that are the same or equivalent are labeled with the same reference signs in the drawings and description thereof is not repeated.

First Embodiment

Figure 2:
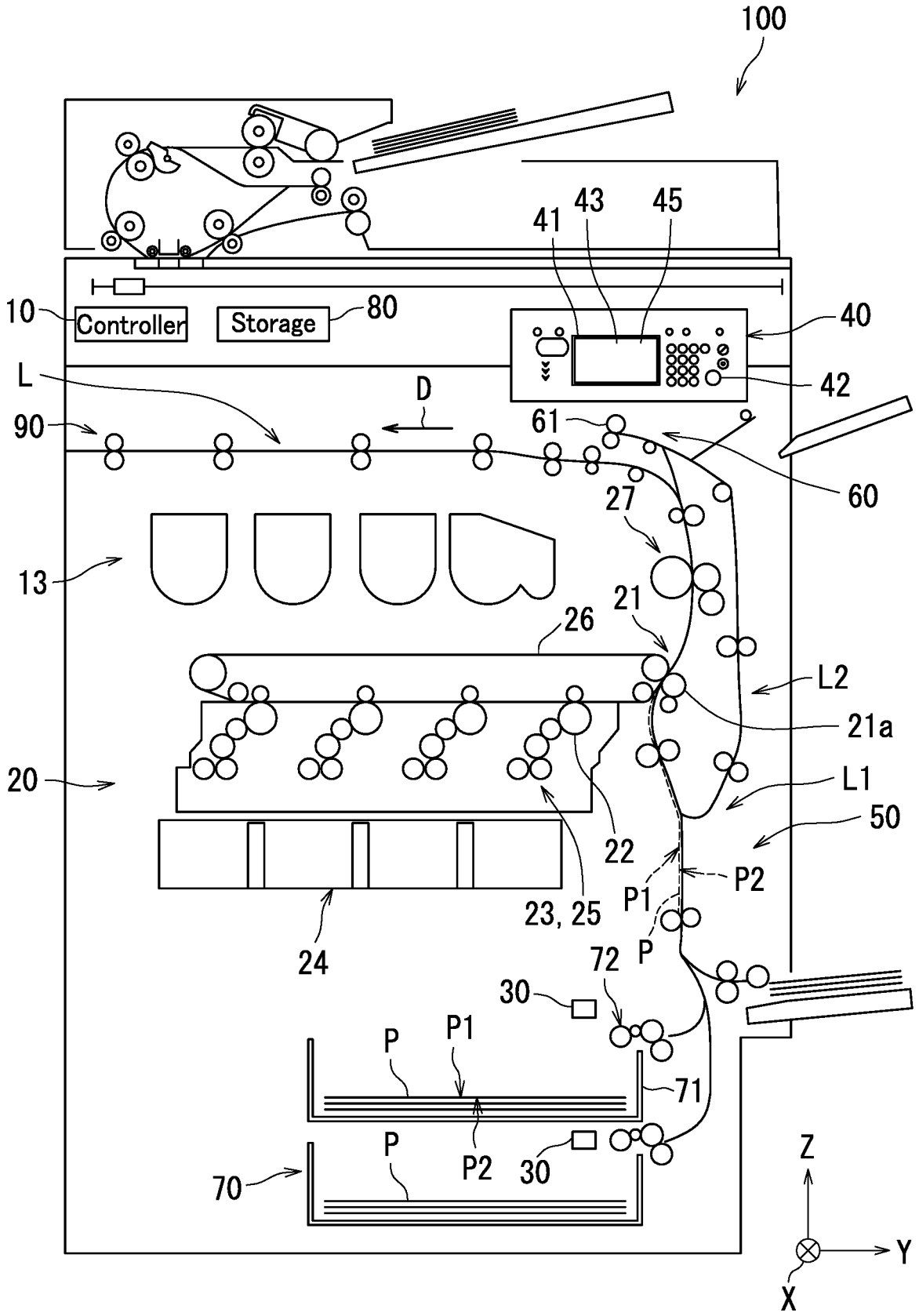
FIG. 2 is a schematic illustration of the image forming apparatus according to the first embodiment of the present disclosure.

The following describes an image forming apparatus 100 according to a first embodiment of the present disclosure with reference to FIGS. 1 and 2. FIG. 1 is a diagram illustrating the image forming apparatus 100. The image forming apparatus 100 may be communicatively connected to a user terminal (personal computer) through a network.

As illustrated in FIG. 1, the image forming apparatus 100 includes a controller 10, an image forming section 20, a detector 30, a display section 40, a conveyance section 50, a reverse conveyance section 60, a feeder 70, and storage 80.

The storage 80 includes a storage device. Specifically, the storage 80 includes a main storage device such as semiconductor memory and an auxiliary storage device such as one or more of semiconductor memory, a solid-state drive, and a hard disk drive. The storage 80 may include removable media. The storage 80 is an example of a recording medium (non-transitory computer-readable storage medium, for example). The storage 80 stores therein data and computer programs such as software.

The controller 10 includes a processor. The processor includes a central processing unit (CPU), for example. The controller 10 controls operation of each element of the image forming apparatus 100. Specifically, the controller 10 controls the image forming section 20, the detector 30, the display section 40, the conveyance section 50, the reverse conveyance section 60, the feeder 70, and the storage 80 by executing a computer program stored in the storage 80.

FIG. 2 is a schematic illustration of the image forming apparatus 100. An electrographic image forming apparatus 100 is described as an example in the present specification, but the present disclosure may also be applied to an inkjet image forming apparatus 100. In the present embodiment, the image forming apparatus 100 is a color multifunction peripheral, for example. As illustrated in FIG. 2, the image forming apparatus 100 includes an ejection section 90, a first conveyance path L1, and a second conveyance path L2.

The feeder 70 includes a cassette 71 and a feed roller 72. The cassette 71 houses a sheet P. The feed roller 72 feeds the sheet P to the first conveyance path L1. Examples of the sheet P include plain paper, copy paper, recycled paper, thin paper, thick paper, glossy paper, and an overhead projector (OHP) sheet. Among one side and another side of the sheet P, an image has not been formed on at least the one side but an image may or may not be formed on the other side in the present embodiment. That is, in the present embodiment, the sheet P is a blank sheet or a reused sheet, for example. The first conveyance path L1 is equivalent to an example of a "conveyance path".

The sheet P has a first side P1 and a second side P2. In FIG. 2, the upper side of the sheet P housed in the cassette 71 is the first side P1 and the lower side is the second side P2. A user places the sheet P in the cassette 71 such that a side of the sheet P on which an image has not been formed faces upward. Accordingly, when the user places the sheet P in a correct orientation in the cassette 71, an image has not been formed on the first side P1 of the sheet P. When the user places the sheet P in an incorrect orientation in the cassette 71, an image has been formed on the first side P1 of the sheet P.

The image forming section 20 forms an image on the sheet P. The image forming section 20 includes a transfer section 21, a plurality of photosensitive drums 22, a plurality of chargers 23, a plurality of exposure sections 24, a plurality of developing sections 25, an intermediate transfer belt 26, and a fixing section 27.

Each photosensitive drum 22 is drum-shaped and has an axis of rotation. The photosensitive drum 22 rotates clockwise around the axis of rotation thereof. The photosensitive drum 22 has a photosensitive layer on the outer circumferential surface thereof. A cyan toner image is formed on one of the photosensitive drums 22. A magenta toner image is formed on another one of the photosensitive drums 22. A yellow toner image is formed on still another one of the photosensitive drums 22. A black toner image is formed on yet another one of the photosensitive drums 22.

Each charger 23 charges the photosensitive layer of a corresponding photosensitive drum 22 to a prescribed potential. Each exposure section 24 radiates laser light to expose the photosensitive layer of a corresponding photosensitive drum 22. The exposure section 24 exposes the photosensitive drum 22 based on image data. As a result, an electrostatic latent image is formed on the photosensitive drum 22.

Each developing section 25 develops the electrostatic latent image formed on a corresponding photosensitive drum 22. The developing section 25 includes a development roller. The development roller supplies toner to the photosensitive drum 22 and develops the electrostatic latent image formed on the photosensitive drum 22 to form a toner image. As a result, a toner image is formed on the outer circumferential surface of the photosensitive drum 22.

The intermediate transfer belt 26 is an endless belt. A toner image with a plurality of colors is formed on the intermediate transfer belt 26. Specifically, the toner images formed on the photosensitive drums 22 are transferred to the intermediate transfer belt 26.

The transfer section 21 includes a transfer roller 21*a*. The transfer roller 21*a* transfers to the sheet P the image previously transferred to the intermediate transfer belt 26. As a result, an image is formed on the sheet P. Here, as illustrated in FIG. 2, the first side P1 of the sheet P conveyed from the feeder 70 faces the intermediate transfer belt 26, and the second side P2 faces the transfer roller 21*a*. Accordingly, the toner image is transferred to the first side P1 of the sheet P. That is, the image forming section 20 forms an image on the first side P1 of the sheet P.

The fixing section 27 applies heat and pressure to the sheet P to fix the image formed on the sheet P to the sheet P. Having passed through the fixing section 27, the sheet P is conveyed to the ejection section 90 by the conveyance section 50.

The display section 40 has a touch panel 41 and an operation button 42. The touch panel 41 has a display device 43 and a touch sensor 45. The display device 43 displays either or both of various screens and images, for example. The display device 43 is a liquid-crystal display (LCD), for example. The touch sensor 45 receives operation from the user. The touch sensor 45 is located over the display surface of the display device 43, for example. The operation button 42 receives operation from the user. The display section 40 is equivalent to an example of a "reporting section". The display section 40 displaying either or both of a screen and an image as information is equivalent to an example of a "reporting section reporting information".

The touch panel 41 generates operation information indicating content of operation from the user each time the operation from the user is received. For example, a plurality of icons is displayed on the touch panel 41. The user taps an icon. The touch panel 41 generates information indicating that the icon has been tapped as the operation information.

The display section 40 changes the image displayed on the touch panel 41 according to the operation from the user. Specifically, the display section 40 displays on the touch panel 41 an image corresponding to the icon operated by the user among the plurality of icons displayed on the touch panel 41. The display section 40 reads out information corresponding to the image displayed on the touch panel 41 from the storage 80.

The first conveyance path L1 extends from the feeder 70 to the ejection section 90. The first conveyance path L1 guides the sheet P from the feeder 70 to the ejection section 90. The conveyance section 50 conveys the sheet P along the first conveyance path L1 in a sheet conveyance direction D. In a case where the first side P1 and the second side P2 of the sheet P are reversed, the conveyance section 50 conveys the sheet P having passed through the fixing section 27 to the reverse conveyance section 60.

The second conveyance path L2 extends from the reverse conveyance section 60 to the first conveyance path L1. Specifically, the second conveyance path L2 extends from the reverse conveyance section 60 to a position on the first conveyance path L1 downstream of the feeder 70 and upstream of the image forming section 20 in the sheet conveyance direction D.

The reverse conveyance section 60 includes a reversing roller 61. The reverse conveyance section 60 reverses the first side P1 and the second side P2 of the sheet P. Specifically, the reversing roller 61 reverses, in the first conveyance path L1, the first side P1 and the second side P2 of the sheet P conveyed from the conveyance section 50 to the reverse conveyance section 60 by conveying the sheet P to the first conveyance path L1 along the second conveyance path L2 with the leading edge of the sheet P set as the trailing edge. In a sheet P for which the first side P1 and the second side P2 are reversed, the first side P1 faces the transfer roller 21*a* and the second side P2 faces the intermediate transfer belt 26. That is, once the first side P1 and the second side P2 of the sheet P are reversed, the image forming section 20 forms an image on the second side P2 of the sheet P.

The detector 30 is positioned upstream of the image forming section 20 in the sheet conveyance direction D. In the present embodiment, the detector 30 is positioned above the cassette 71. Examples of the detector 30 include a complementary metal-oxide-semiconductor (CMOS) image sensor and a charge-coupled device (CCD) sensor. The detector 30 is preferably a contact image sensor (CIS) unit, for example.

The detector 30 detects whether or not an image has been formed on the first side P1 of the sheet P. Specifically, the detector 30 detects whether or not an image has been formed on the first side P1 of the sheet P housed in the cassette 71. The manufacturing cost of the image forming apparatus 100 can be reduced more in a case where the detector 30 is a CMOS image sensor or a CCD sensor than in a case where the detector 30 is a CIS unit. In a case where the detector 30 is a CIS unit, the entire first side P1 of the sheet P can be detected. As a result, whether or not an image has been formed on the first side P1 of the sheet P can be more accurately detected.

The detector 30 detecting that an image has been formed on the first side P1 of the sheet P is equivalent to a side with an image formed thereon of the sheet P facing the intermediate transfer belt 26 in the transfer section 21. Accordingly, in a case where the detector 30 detects that an image has been formed on the first side P1 of the sheet P, the image forming section 20 forms an image on the side with an image formed thereon of the sheet P if image formation on the sheet P is continued without reversing the sheet P.

The ejection section 90 ejects the sheet P out of the image forming apparatus 100. Specifically, the ejection section 90 ejects the sheet P having passed through the fixing section 27 out of the image forming apparatus 100.

Next, the controller 10 is described with reference to FIGS. 1 and 2. The processor of the controller 10 functions as a receiver 11, an operation controller 12, a display controller 13, and a receiving section 14 by executing a computer program stored in the storage device of the storage 80. That is, the controller 10 includes a receiver 11, an operation controller 12, a display controller 13, and a receiving section 14.

The receiver 11 for example receives a print job from the user terminal through the network. The print job includes for example image data and an instruction to form an image on the sheet P based on the image data. The print job may also include for example an instruction for the image forming section 20 to further form an image over an image already formed on the first side P1 of the sheet P (may be referred to in the following as a "superimposed printing instruction"). Specifically, the print job may include an instruction for the image forming section 20 to form a character image over an entry column image already formed on the sheet P.

The operation controller 12 controls operation of the image forming section 20 based on the print job. That is, the image forming section 20 operates based on the print job. The operation controller 12 also controls operation of the conveyance section 50 and the reverse conveyance section 60, for example.

The display controller 13 for example controls the display section 40 so as to display either or both of various screens and images. For example, when the detector 30 detects that an image has been formed on the first side P1 of the sheet P, the display controller 13 causes the display section 40 to display information indicating that an image has been formed on the first side P1 of the sheet P. Accordingly, the user can know that the one side and the other side of the sheet P housed in the image forming apparatus 100 (cassette 71) are inverted by viewing the information displayed on the display section 40. As a result, the user can be alerted that the sheet P is placed in an incorrect orientation in the image forming apparatus 100.

For example, in a case where the detector 30 detects that an image has been formed on the first side P1 of the sheet P, the display controller 13 causes the display section 40 to display information for receiving an instruction from the user as to whether or not to continue image formation on the sheet P. In this case, the user enters an instruction through the display section 40 as to whether or not to continue image formation on the sheet P.

The receiving section 14 for example receives an instruction from the user through the display section 40. Specifically, in a case where the user inputs through the display section 40 an instruction to continue image formation on the sheet P, the receiving section 14 receives through the display section 40 the instruction to continue image formation on the sheet P. In a case where the user inputs through the display section 40 an instruction not to continue image formation on the sheet P, the receiving section 14 receives through the display section 40 an instruction to stop image formation on the sheet P.

The operation controller 12 controls the operation of the image forming section 20 based on the instruction received by the receiving section 14 as to whether or not to continue image formation on the sheet P. For example, the operation controller 12 controls the operation of the image forming section 20 so as to continue image formation on the sheet P when the receiving section 14 receives the instruction to continue image formation on the sheet P. By contrast, the operation controller 12 controls the operation of the image forming section 20 so as to stop image formation on the sheet P when the receiving section 14 receives the instruction not to continue image formation on the sheet P. The sheet P on which image formation has been stopped is ejected out of the image forming apparatus 100 by the ejection section 90 without an image being formed thereon. Accordingly, the user can select whether or not to continue image formation on the sheet P according to the purpose of the sheet P even in a case where the sheet P is conveyed with the one side and the other side thereof reversed. As a result, convenience is improved for the user.

In response to the receiving section 14 receiving the instruction to continue image formation on the sheet P, the display controller 13 causes the display section 40 to display for example information related to reversal of the sheet P. Specifically, the display controller 13 causes the display section 40 to display information for receiving an instruction from the user as to whether or not to reverse the first side P1 and the second side P2 of the sheet P. The user enters the instruction as to whether or not to continue image formation on the sheet P through the display section 40. The receiving section 14 then receives the instruction from the user through the display section 40 as to whether or not to reverse the first side P1 and the second side P2 of the sheet P. That is, the receiving section 14 receives the instruction from the user through the display section 40 as to whether or not to reverse the first side P1 and the second side P2 of the sheet P when the detector 30 detects that an image has been formed on the first side P1 of the sheet P.

Based on the instruction related to reversal of the sheet P and received by the receiving section 14, the operation controller 12 controls the operation of the reverse conveyance section 60. For example, the operation controller 12 controls the operation of the reverse conveyance section 60 so as to reverse the first side P1 and the second side P2 of the sheet P when the receiving section 14 receives an instruction to reverse the first side P1 and the second side P2 of the sheet P. Accordingly, the first side P1 and the second side P2 of the sheet P can be reversed inside the image forming apparatus 100 without the user manually reversing the first side P1 and the second side P2 of the sheet P even in a case where the sheet P has been placed in an incorrect orientation in the cassette 71. As a result, a burden on the user to manually reverse the first side P1 and the second side P2 of the sheet P can be eliminated and convenience is improved for the user.

By contrast, in a case where the receiving section 14 receives the instruction not to reverse the first side P1 and the second side P2 of the sheet P, the operation controller 12 controls the operation of the image forming section 20 to form an image on the first side P1 of the sheet P without reversing the first side P1 and the second side P2 of the sheet P. Accordingly, image formation on the sheet P can continue according to the purpose of the sheet P without reversing the first side P1 and the second side P2 of the sheet P even in a case where the sheet P is conveyed with a side thereof that has an image formed thereon facing the intermediate transfer belt 26. As a result, unnecessary reversal of the first side P1 and the second side P2 of the sheet P can be prevented and convenience is improved for the user.

Note that in a case where the print job includes a superimposed printing instruction, the image forming section 20 forms an image on the first side P1 of the sheet P independent of a result of detection by the detector 30. Accordingly, image formation on the sheet P can continue according to the instruction included in the print job without receiving an instruction related to continuation of image formation from the user even in a case where an image has been formed on the first side P1 of the sheet P. As a result, a burden on the user to enter an instruction related to the continuation of image formation through the display section 40 can be eliminated and convenience is improved for the user.

Furthermore, in a case where the print job includes a superimposed printing instruction, the display controller 13 does not cause the display section 40 to display information indicating that an image has been formed on the first side P1 of the sheet P. Accordingly, the display section 40 can be prevented from unnecessarily displaying information indicating that an image has been formed on the first side P1 of the sheet P.

Figure 3:
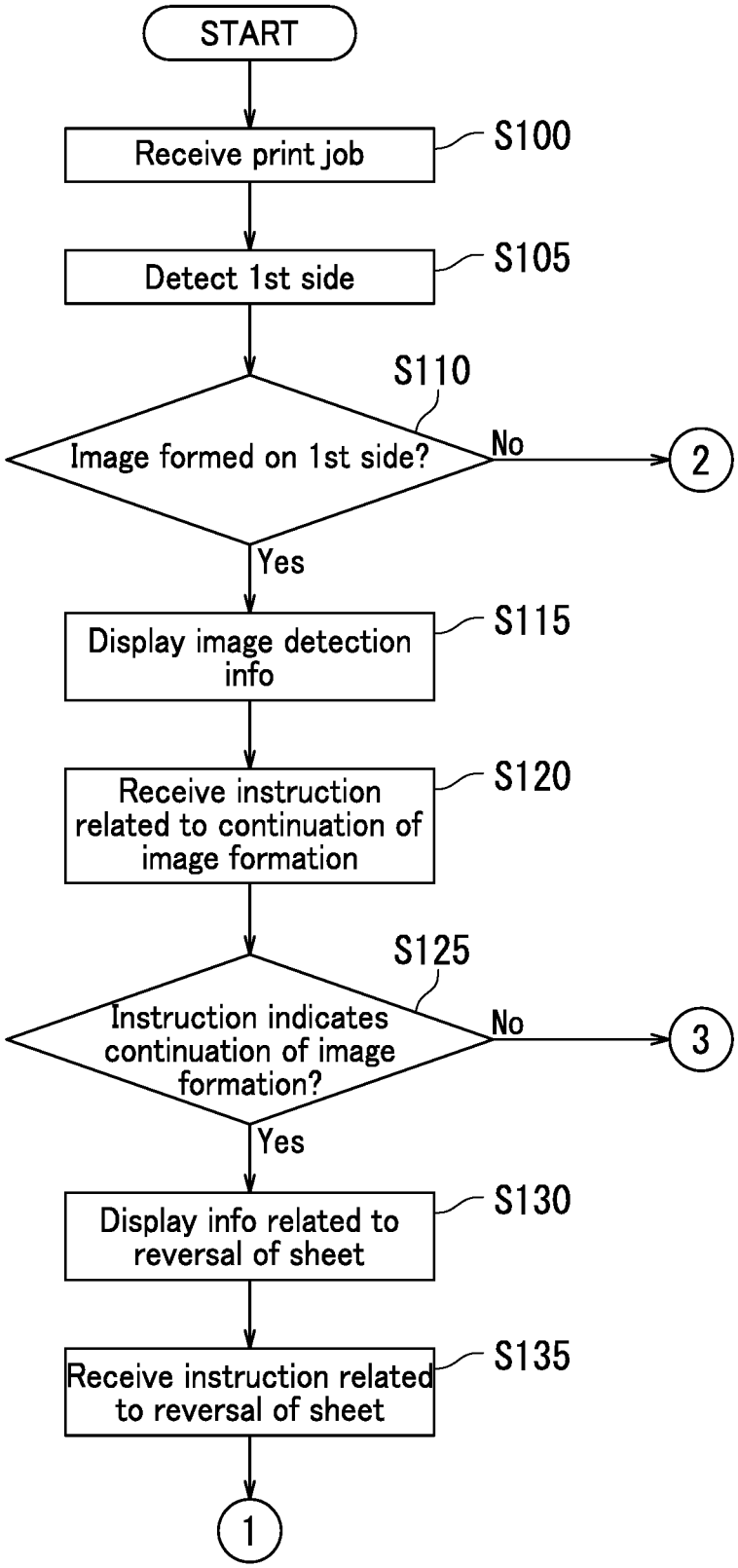
FIG. 3 is a flowchart depicting a first half of a process performed by the image forming apparatus according to the first embodiment of the present disclosure.
Figure 4:
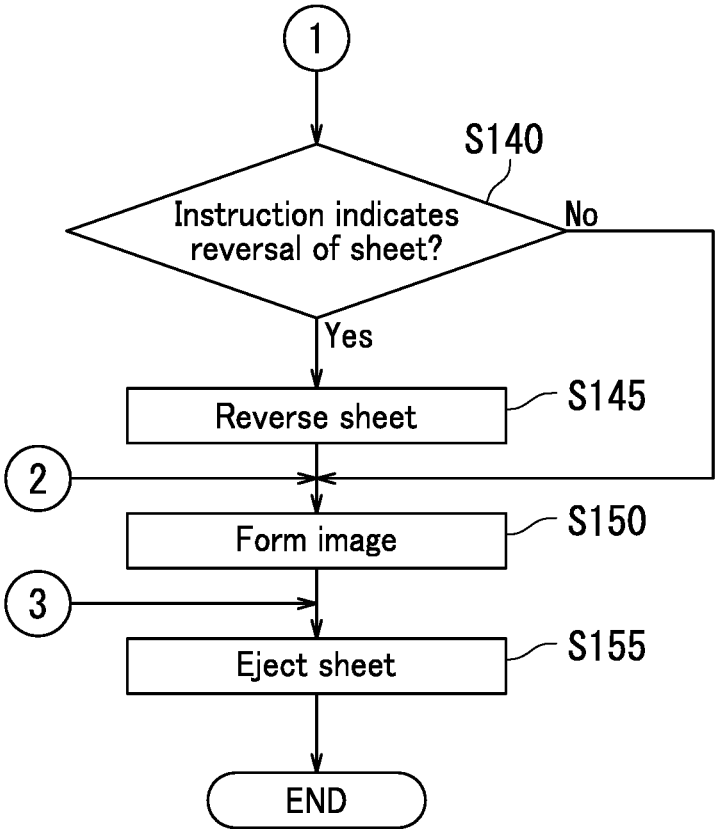
FIG. 4 is a flowchart depicting a second half of the process performed by the image forming apparatus according to the first embodiment of the present disclosure.

Next, the operation of the image forming apparatus 100 of the first embodiment is described with reference to FIGS. 3 and 4. FIG. 3 is a flowchart depicting a first half of a process performed by the image forming apparatus 100. FIG. 4 is a flowchart depicting a second half of the process performed by the image forming apparatus 100.

In Step S100, the receiver 11 receives a print job from the user terminal. In Step S105, the detector 30 detects whether or not an image has been formed on the first side P1 of the sheet P. In Step S110, the controller 10 determines whether or not an image has been formed on the first side P1 of the sheet P based on the result of detection by the detector 30 in Step S105. When an affirmative determination (Yes) is made in Step S110, that is, the detector 30 detects that an image has been formed on the first side P1 of the sheet P, the process advances to Step S115.

In Step S115, the display controller 13 controls the display section 40 so as to display information indicating that an image has been formed on the first side P1 of the sheet P as image detection information. As a result, the display section 40 displays the information indicating that an image has been formed on the first side P1 of the sheet P. Additionally, the display controller 13 causes the display section 40 to display information for receiving an instruction from the user as to whether or not to continue image formation on the sheet P. As a result, the display section 40 displays the information for receiving an instruction from the user as to whether or not to continue image formation on the sheet P.

In Step S120, the receiving section 14 receives an instruction from the user through the display section 40 as to whether or not to continue image formation on the sheet P. In Step S125, the receiving section 14 determines whether or not the instruction received in Step S120 indicates continuation of image formation on the sheet P. When an affirmative determination (Yes) is made in Step S125, that is, the receiving section 14 receives an instruction to continue image formation on the sheet P, the process advances to Step S130.

In Step S130, the display controller 13 causes the display section 40 to display information related to reversal of the sheet P. Specifically, the display controller 13 causes the display section 40 to display information for receiving an instruction from the user as to whether or not to reverse the first side P1 and the second side P2 of the sheet P. As a result, the display section 40 displays a screen for receiving an instruction from the user as to whether or not to reverse the first side P1 and the second side P2 of the sheet P.

In Step S135, the receiving section 14 receives an instruction related to the reversal of the sheet P through the display section 40. That is, the receiving section 14 receives an instruction from the user through the display section 40 as to whether or not to reverse the first side P1 and the second side P2 of the sheet P.

In Step S140, the receiving section 14 determines whether or not the instruction received in Step S135 is an instruction to reverse the first side P1 and the second side P2 of the sheet P. When an affirmative determination (Yes) has been made, that is, when the instruction received by the receiving section 14 is an instruction to reverse the first side P1 and the second side P2 of the sheet P, the process advances to Step S145.

In Step S145, the operation controller 12 controls the operation of the reverse conveyance section 60 so as to reverse the first side P1 and the second side P2 of the sheet P. As a result, the reverse conveyance section 60 reverses the first side P1 and the second side P2 of the sheet P.

In Step S150, the operation controller 12 controls the image forming section 20 so as to form an image on the sheet P. As a result, the image forming section 20 forms an image on the sheet P.

In Step S155, the operation controller 12 controls the conveyance section 50 and the ejection section 90 so as to eject the sheet P out of the image forming apparatus 100. As a result, the conveyance section 50 and the ejection section 90 eject the sheet P out of the image forming apparatus 100.

Note that when a negative determination (No) is made in Step S110, that is, an image has not been formed on the first side P1 of the sheet P, the process advances to Step S150. An image not having been formed on the first side P1 of the sheet P is equivalent to an image not having been formed on the first side P1 of the sheet P to which a toner image is to be transferred. Accordingly, when an image has not been formed on the first side P1 of the sheet P, the image forming section 20 forms an image on the first side P1 of the sheet P without the receiving section 14 receiving an instruction related to continuation of image formation from the user in Step S150.

Furthermore, when a negative determination (No) is made in Step S125, that is, the receiving section 14 receives an instruction not to continue image formation on the sheet P, the process advances to Step S155. In this case, the sheet P is ejected out of the image forming apparatus 100 without the image forming section 20 forming an image on the first side P1 or the second side P2 of the sheet P.

Additionally, when a negative determination (No) is made in Step S140, that is, when the instruction received by the receiving section 14 is an instruction not to reverse the sheet P, the process advances to Step S150. In this case, in Step S150, the image forming section 20 forms an image on the first side P1 of the sheet P with an image already formed thereon.

Second Embodiment

Next, an image forming apparatus 100*a* of a second embodiment is described with reference to FIGS. 5 and 6. The image forming apparatus 100*a* of the second embodiment differs from the image forming apparatus 100 of the first embodiment in that the controller 10 includes a calculating section 15 and a determining section 16. In the second embodiment as follows, items which differ from the first embodiment are described and description of elements shared with the first embodiment is omitted.

Figure 5:
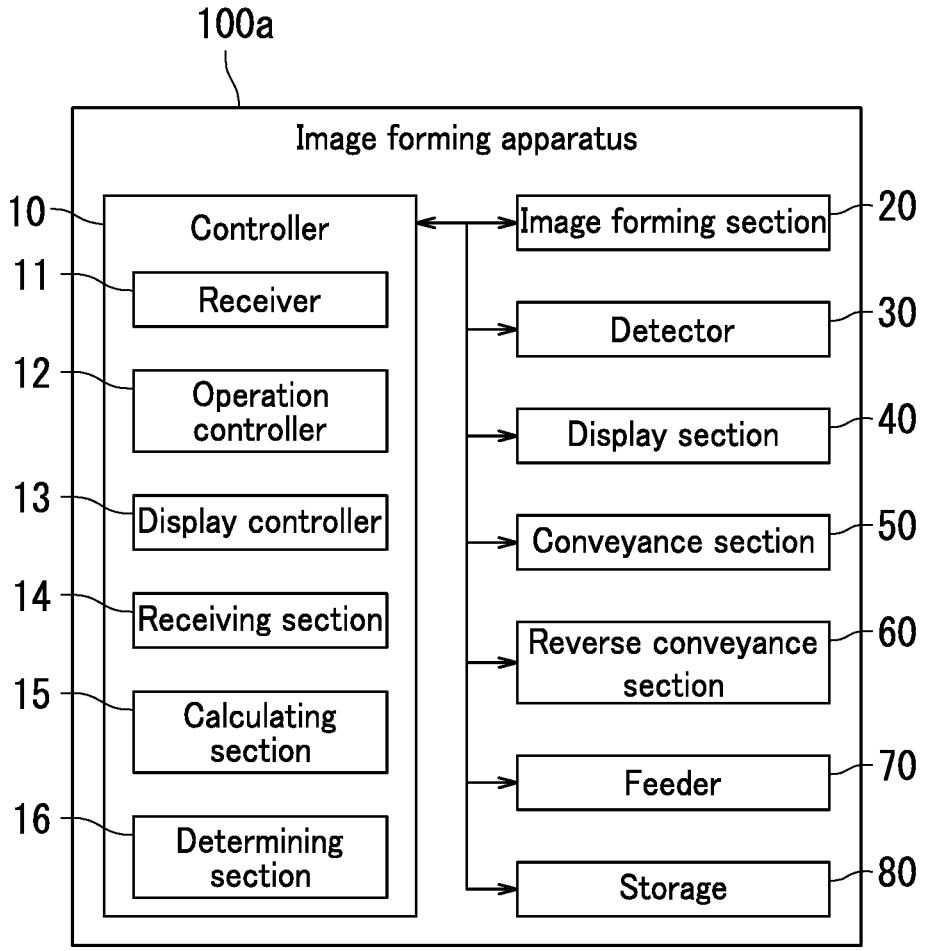
FIG. 5 is a diagram illustrating an image forming apparatus according to a second embodiment of the present disclosure.

FIG. 5 is a diagram illustrating the image forming apparatus 100*a* of the second embodiment. The processor of the controller 10 functions as the receiver 11, the operation controller 12, the display controller 13, the receiving section 14, the calculating section 15, and the determining section 16 by executing a computer program stored in the storage device of the storage 80. That is, the controller 10 includes the receiver 11, the operation controller 12, the display controller 13, the receiving section 14, the calculating section 15, and the determining section 16. The receiver 11, the operation controller 12, the display controller 13, and the receiving section 14 are the same as in the first embodiment, and description thereof is accordingly omitted.

The calculating section 15 calculates an image detection count through detection by the detector 30 each time the detector 30 detects that an image has been formed on the first side P1 of the sheet P. The determining section 16 determines whether or not the image detection count through detection by the detector 30 is equal to or greater than a threshold. Accordingly, either or both of the operation controller 12 and the display controller 13 can control at least one element included in the image forming apparatus 100*a* according to a result of determination by the determining section 16. For example, the display controller 13 can cause the display section 40 to display information indicating that the sheet P is placed in an incorrect orientation in the cassette 71 only when the determining section 16 determines that the detection count is equal to or greater than the threshold. As a result, trouble for the user of constantly identifying that the sheet P is placed in an incorrect orientation in the cassette 71 can be reduced.

When the determining section 16 determines that the image detection count through detection by the detector 30 is equal to or greater than the threshold, the display controller 13 for example causes the display section 40 to display information for receiving an instruction from the user as to whether or not to continue image formation on the sheet P. In this case, the user enters through the display section 40 an instruction as to whether or not to continue image formation on the sheet P. The receiving section 14 then receives an instruction from the user through the display section 40 as to whether or not to continue image formation on the sheet P. That is, when the determining section 16 determines that the image detection count is equal to or greater than the threshold, the receiving section 14 receives an instruction from the user through the display section 40 as to whether or not to continue image formation on the sheet P. The operation controller 12 then controls the operation of the image forming section 20 based on the instruction received by the receiving section 14 as to whether or not to continue image formation on the sheet P.

By contrast, in the present embodiment, when the determining section 16 determines that the image detection count through detection by the detector 30 is less than the threshold for example, the image forming section 20 continues image formation on the sheet P without the receiving section 14 receiving an instruction related to continuation of image formation from the user. Accordingly, the display section 40 does not display information for receiving an instruction as to whether or not to continue image formation on the sheet P until the image detection count through detection by the detector 30 reaches the threshold even in a case where the sheet P is placed in an incorrect orientation in the cassette 71. As a result, trouble for the user caused by constantly entering an instruction as to whether or not to continue image formation on the sheet P can be reduced.

FIG. 6 is a diagram illustrating a threshold table Tb. As illustrated in FIG. 6, the threshold table Tb stores user names C1, user IDs C2, thresholds C3, and detection counts C4 in association with each other. Each user name C1 exhibits a name of a user. Each user ID C2 exhibits identification information identifying a user. In the present embodiment, the user ID C2 exhibits an ID which identifies the user. Each threshold C3 exhibits a threshold set per user. Each detection count C4 exhibits an image detection count calculated per user.

In a case where multiple users use the image forming apparatus 100*a*, the threshold is set per user. The calculating section 15 calculates an image detection count through detection by the detector 30 per user. The determining section 16 then determines whether or not the image detection count is equal to or greater than the threshold per user. The threshold can be arbitrarily set by a user. Accordingly, the occasion at which the display section 40 displays information indicating that the sheet P is placed in an incorrect orientation in the cassette 71 can be adjusted according to the usage of the image forming apparatus 100*a* per user.

For example, the user ID C2 of a user 1 is "NN1", the threshold C3 is "5", and the detection count C4 is "0". Accordingly, when the detector 30 has successively detected an image five times in operation of the image forming apparatus 100*a* based on a print job received from the user 1, the display section 40 displays information for receiving an instruction as to whether or not to continue image formation on the sheet P. For another example, the threshold C3 of a user 2 is "10" and the detection count C4 is "1". Accordingly, when the detector 30 has successively detected an image nine times in operation of the image forming apparatus 100*a* based on a print job received from the user 2, the display section 40 displays information for receiving an instruction as to whether or not to continue image formation on the sheet P.

Figure 7:
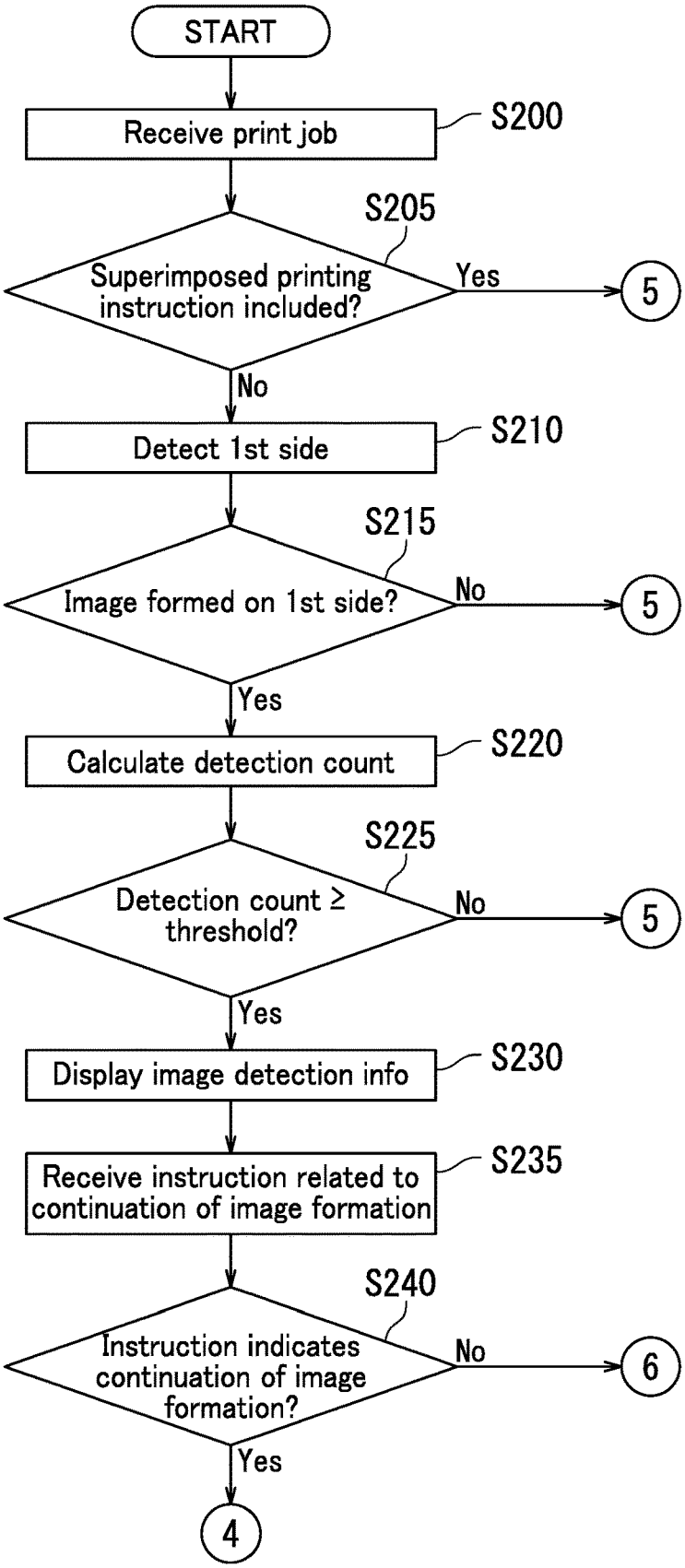
FIG. 7 is a flowchart depicting a first half of a process performed by the image forming apparatus according to the second embodiment of the present disclosure.
Figure 8:
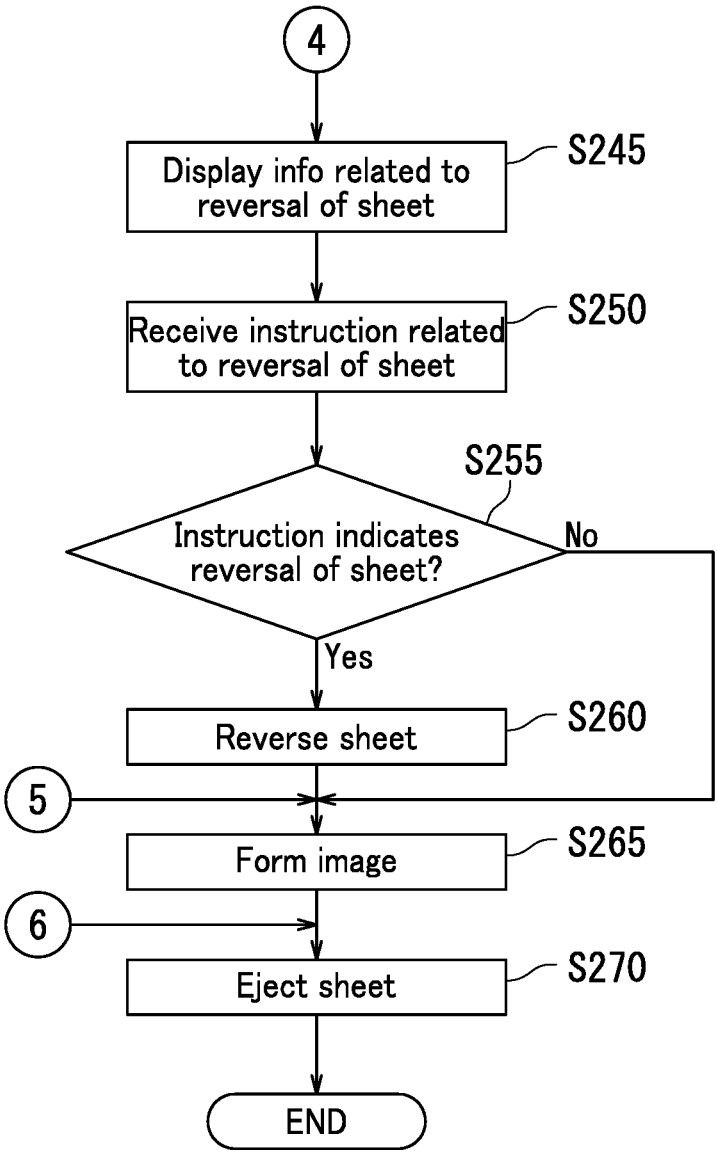
FIG. 8 is a flowchart depicting a second half of the process performed by the image forming apparatus according to the second embodiment of the present disclosure.

Next, a process performed by the image forming apparatus 100*a* according to the second embodiment is described with reference to FIGS. 7 and 8. FIG. 7 is a flowchart depicting a first half of the process performed by the image forming apparatus 100*a* according to the second embodiment. FIG. 8 is a flowchart depicting a second half of the process performed by the image forming apparatus 100*a* according to the second embodiment. Step S200 in FIG. 7 has the same processing content as Step S100 in FIG. 3, Steps S210 and S215 in FIG. 7 respectively have the same processing content as Steps S105 and S110 in FIG. 3, and Steps S230 to S270 in FIGS. 7 and 8 respectively have the same processing content as Steps S115 to S155 in FIGS. 3 and 4. As such, description thereof is omitted.

In Step S205, the receiver 11 determines whether or not a print job includes a superimposed printing instruction. When a negative determination (No) is made in Step S205, that is, when the print job does not include a superimposed printing instruction, the process advances to Step S210. By contrast, when an affirmative determination (Yes) is made in Step S205, that is, when the print job does include a superimposed printing instruction, the process advances to Step S265. That is, in a case where the print job includes a superimposed printing instruction, the image forming section 20 forms an image on the first side P1 of the sheet P independent of the result of detection by the detector 30.

In Step S220, the calculating section 15 calculates the image detection count through detection by the detector 30. In Step S225, the determining section 16 determines whether or not the image detection count through detection by the detector 30 is equal to or greater than the threshold.

When an affirmative determination (Yes) is made in Step S225, that is, when the image detection count through detection by the detector 30 is equal to or greater than the threshold, the process advances to Step S230. When a negative determination (No) is made in Step S225 by contrast, that is, when the image detection count through detection by the detector 30 is less than the threshold, the process advances to Step S265. Accordingly, when the image detection count through detection by the detector 30 is less than the threshold, the image forming section 20 continues image formation on the first side P1 of the sheet P without the display controller 13 causing the display section 40 to display information indicating that an image has been formed on the first side P1 of the sheet P even in a case where the sheet P is placed in an incorrect orientation in the cassette 71.

Embodiments of the present disclosure are described above with reference to the accompanying drawings. However, the present disclosure is not limited to the above embodiments and may be implemented in various manners within a scope not departing from the gist thereof. Furthermore, various disclosures may be created by appropriately combining the elements of configuration disclosed in the above embodiments. For example, some elements of configuration may be removed from the entirety thereof illustrated in the above embodiments. In addition, elements of configuration may be appropriately combined across different embodiments. The drawings illustrate main elements of configuration schematically to facilitate understanding. Aspects such as thickness, length, number, and interval of the elements of configuration illustrated in the drawings may differ in practice for convenience of drawing preparation. Furthermore, aspects such as speed, material, shape, and dimension of the elements of configuration illustrated in the above embodiments are examples and not particular limitations. The elements of configuration may be variously altered within a scope not substantially departing from the configuration of the present disclosure.

(1) In the first and second embodiments as described with reference to FIG. 2, the reporting section is the display section 40. However, the reporting section need only report information to the user, and may be an audio output section. In this case, the audio output section reports information to the user using an alarm sound or the like.

(2) In the first embodiment as described with reference to FIGS. 1 and 2, the image forming apparatus 100 includes the reverse conveyance section 60. The image forming apparatus 100*a* in the second embodiment also includes the reverse conveyance section 60. However, either or both of the image forming apparatus 100 and the image forming apparatus 100*a* may not include the reverse conveyance section 60.

(3) As described with reference to FIGS. 1 and 2, when the receiving section 14 receives an instruction not to continue image formation on the sheet P, the sheet P for which image formation has been stopped is conveyed by the feed roller 72 and ejected out of the image forming apparatus 100 without an image being formed thereon. However, the feed roller 72 need not convey the sheet P in response to detection of an image having been formed on the first side P1 of the sheet P. That is, the feed roller 72 may stop feeding of the sheet P to the first conveyance path L1 in response to the detector 30 detecting that an image has been formed on the first side P1 of the sheet P. When the receiving section 14 receives an instruction not to continue image formation on the sheet P, the feed roller 72 may stop feeding of the sheet P for which image formation has been stopped to the first conveyance path L1. In this case, the user manually reverses the sheet P placed in an incorrect orientation in the cassette 71. Accordingly, a situation in which the conveyance section 50 unnecessarily conveys the sheet P can be prevented. As a result, degradation of the conveyance section 50 due to the conveyance of the sheet P can be prevented, for example.

What is claimed is:

1. An image forming apparatus comprising:

an image forming section configured to form an image on a first side of a sheet, the sheet having the first side and a second side;

a detector positioned upstream of the image forming section in a sheet conveyance direction, and configured to detect whether or not an image has been formed on the first side of the sheet;

a reporting section configured to report information indicating that an image has been formed on the first side of the sheet when the detector detects that an image has been formed on the first side of the sheet;

a calculating section configured to calculate an image detection count through detection by the detector each time the detector detects that an image has been formed on the first side of the sheet;

a determining section configured to determine whether or not the image detection count is equal to or greater than a threshold;

a receiving section configured to receive an instruction from a user through the reporting section when the determining section determines that the detection count is equal to or greater than the threshold, the instruction being an instruction as to whether or not to continue image formation on the sheet; and an operation controller configured to control operation of the image forming section based on the instruction, wherein the image forming section continues image formation on the sheet when the determining section determines that the image detection count is less than the threshold, when the receiving section receives an instruction to continue image formation on the sheet, the operation controller controls the operation of the image forming section so as to continue image formation on the sheet, when the receiving section receives an instruction not to continue image formation on the sheet, the operation controller controls the operation of the image forming section so as to stop image formation on the sheet, the image forming section operates based on a print job, and when the print job includes an instruction to cause the image forming section to form an image over an image which has been already formed on the first side of the sheet, the image forming section forms an image on the first side of the sheet independent of a result of detection by the detector.

2. The image forming apparatus according to claim 1, wherein the threshold is set per user, and the calculating section calculates the detection count per the user.

3. The image forming apparatus according to claim 1, further comprising:

a reverse conveyance section configured to reverse the first side and the second side of the sheet wherein the receiving section receives an instruction from a user through the reporting section when the detector detects that an image has been formed on the first side of the sheet, the instruction being an instruction as to whether or not to reverse the first side and the second side of the sheet, and the operation controller controls operation of the reverse conveyance section so as to reverse the first side and the second side of the sheet when the receiving section receives an instruction to reverse the first side and the second side of the sheet.

4. The image forming apparatus according to claim 1, further comprising a cassette configured to house the sheet, wherein the detector detects whether or not an image has been formed on the first side of the sheet housed in the cassette.

5. The image forming apparatus according to claim 1, further comprising a display controller, wherein the reporting section is a display section controlled by the display controller, and the display section is controlled by the display controller to display either or both of a screen and an image as the information.

6. The image forming apparatus according to claim 1, further comprising:

a conveyance section configured to convey the sheet along a conveyance path; and a feeder configured to feed the sheet to the conveyance path, wherein when the receiving section receives an instruction not to continue image formation on the sheet, the sheet is fed by the feeder and ejected out of the image forming apparatus without an image being formed thereon.

7. The image forming apparatus according to claim 1, further comprising:

a conveyance section configured to convey the sheet along a conveyance path; and a feeder configured to feed the sheet to the conveyance path, wherein the feeder stops feeding the sheet to the conveyance path in response to the detector detecting that an image has been formed on the first side of the sheet.

* * * * *